United States Patent [19]

Gumb

[11] 4,050,768

[45] Sept. 27, 1977

[54] INTERCONNECTOR FOR ADAPTING EXISTING TELEPHONE OUTLETS TO PLUG-IN OUTLETS

[75] Inventor: Beverley William Gumb, London, Canada

[73] Assignee: Northern Telecom Limited, Montreal, Canada

[21] Appl. No.: 714,632

[22] Filed: Aug. 16, 1976

[51] Int. Cl.[2] ..... H01R 31/06

[52] U.S. Cl. ..... 339/154 A; 179/1 PC; 339/156 R

[58] Field of Search ..... 339/154 R, 154 A, 156 R; 179/1 PC

[56] References Cited

U.S. PATENT DOCUMENTS

| | | | |
|---|---|---|---|
| 3,513,261 | 5/1970 | Dal Monte | 179/1 PC |
| 3,617,985 | 11/1971 | Kehl | 179/1 PC |
| 3,668,324 | 6/1972 | Firestone | 339/156 R |
| T947,007 | 6/1976 | Krumreich | 339/154 A |

*Primary Examiner*—Roy Lake
*Assistant Examiner*—Mark S. Bicks
*Attorney, Agent, or Firm*—Sidney T. Jelly

[57] ABSTRACT

An interconnector for adapting existing telephone outlets to accept plug-in units or items has a main portion adapted to attach to the existing outlet after removal of the cover or lid of the outlet. The interconnector has a form which adapts to either of the two types of outlet used, and provides correct rotational orientation for correct interconnection of contacts. Contact is made by spring contact members pressing on the screw terminals of the outlet. A clip-on cover with a prewired jack therein is provided.

3 Claims, 10 Drawing Figures

INTERCONNECTOR FOR ADAPTING EXISTING TELEPHONE OUTLETS TO PLUG-IN OUTLETS

This invention relates to an interconnector for adapting existing telephone outlets to plug-in outlets. Until recently, telephones in domestic premises were connected by a line cord to an outlet, usually in a wall, the line cord either being connected in a semipermanent condition by spade terminal ends on the cord and screw terminals in the outlet, or by the use of a four pin plug and jack.

The present invention is concerned with the provision of an interconnector for use with the outlet having screw terminals. It provides for the use of the recently introduced miniature plug on the end of the line cord and a cooperative jack in the interconnector. The plug is removable, and replaceable, at will by the telephone user. Generally the interconnector is used to allow additional items to be used.

There are two basic forms of wall outlet at present in use, having different configurations. It is intended that the interconnector be usable with either outlet. Also, a predetermined orientation of the interconnector relative to the outlet is provided. To meet regulations that the screw terminals must not be interfered with, contact is made with the terminals by spring contacts. The interconnect is capable of installation by the telephone user without the need for telephone company service personnel.

The invention will be readily understood by the following description in conjunction with the accompanying drawings, in which.

Figure 1:
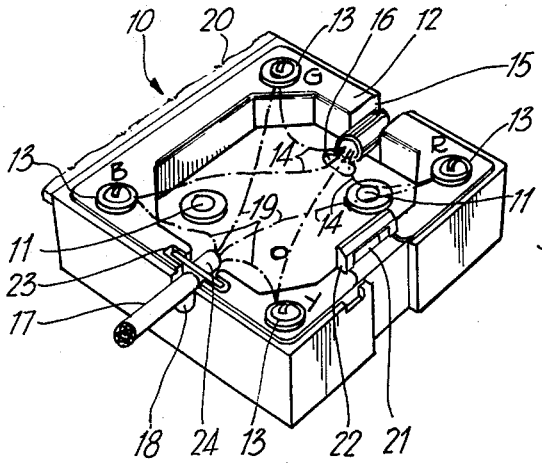
FIG. 1 is a perspective view of one present form of outlet.
Figure 2:
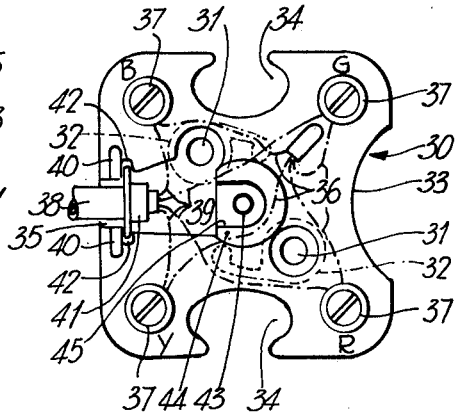
FIG. 2 is a perspective view of another form of outlet.

FIGS. 1 and 2 illustrate the two designs of outlet most commonly in use in domestic and similar premises. The outlets are plastic mouldings. The form in FIG. 1 is a square body portion 10, attached to a support structure, as a wall, by screws passing through holes 11. The body is recessed having a raised rim portion 12. At the four corners of the rim portion 12 are screw terminals 13. The conductors 14 from the telephone system enter via a slot 15 in one side of the outlet, or through an aperture 16 in the base of the outlet. The conductors 14 are connected to the screw terminals 13.

The line cord to the telephone set, indicated at 17, enters the outlet via a recess 18 in the side of the outlet, the recess 18 on the opposite side of the outlet relative to the slot 15. The wires 19, of the cord 17, are connected to the screw terminals 13 also. The outlet has a clip or cover connected to the body portion 10 by a live hinge portion. For the present invention this cover is removed by cutting along the hinge portion, as indicated at 20. The cover has a formation which engages in a recess 21 in a protrusion 22 extending from the rim portion 12 on the side opposite to that of the hinge portion. The recess 18 has slots 23 extending laterally therefrom for reception of a strain relief member 24 on the cord 17.

The outlet of FIG. 2 comprises a flat main body portion 30, again attached to a support structure by screws through holes 31. The body portion is raised from the surface of the support structure by bosses 32 surrounding the holes 31 on the rear side of the body portion. The body portion has a particular external profile in that one side has an arcuate recess 33 while the sides adjacent to the side containing the recess 33 have reentrant recesses 34, the openings to the recesses 34 being narrower than the recesses themselves at their widest part. A groove 35 is formed in the body portion 30 at the side opposite to that with recess 33.

The conductors from the system, indicated at 36, enter via one of the recesses 34, and are connected to screw terminals 37, one at each corner of the body portion 30. The line cord 38, from the telephone set, enters via the groove 35, the wires 39 also connected to the screw terminals 37. At each side of the groove 35 is an upwardly projecting rib 40. A strain relief member 41 on the cord 38 fits behind the ribs 40 and also fitting in short slots 41 in the body portion 30.

In this form of outlet, a separate cover is provided, being attached by a screw which passes through the cover into a threaded insert 43 in the centre of the body portion 30. A raised boss 44 surrounds the insert 43, the boss having a slot 45 through one side, aligned with the groove 35. The cover and screw are not shown in FIG. 2 and are discarded for the present invention.

The screw terminals 13 of the outlet of FIG. 1 and the screw terminals 37 of the outlet of FIG. 2 have a unique relationship in that the particular conductor connection arrangement is the same for both outlets. Embossed letters 46 are formed adjacent each terminal to give a color coding for wire connection. This is the same for both outlets.

It is intended that the interconnector be attached by the telephone customer without special tools and without interfering with the screw terminals of the outlet. For the outlet of FIG. 1 the lid is opened and cut off close to the body portion. For the outlet of the type of FIG. 2, the cover is removed. Generally, the cord 17 or 38 is left connected and the interconnector installed. The customer then has the telephone set connected in the conventional manner and can plug in additional items of equipment, such as a "hands free" unit, a telephone answering unit, or even a further telephone. However, in some circumstances the cords 17 or 38 can be removed, as by cutting the wires 19 and 39. This will depend upon restrictions by the telephone system.

The interconnector is provided with a ready wired jack and a clip-on cover. The customer only has to position the interconnector over the outlet, in the correct orientation, and fasten the interconnector to the outlet. Because of the different forms of the two outlets, the interconnector is provided with formations which cooperate with particular parts of an outlet. Also, for the outlet of FIG. 1, an adaptor part is provided to provide a threaded insert for a screw to hold on the interconnector.

Figure 3:
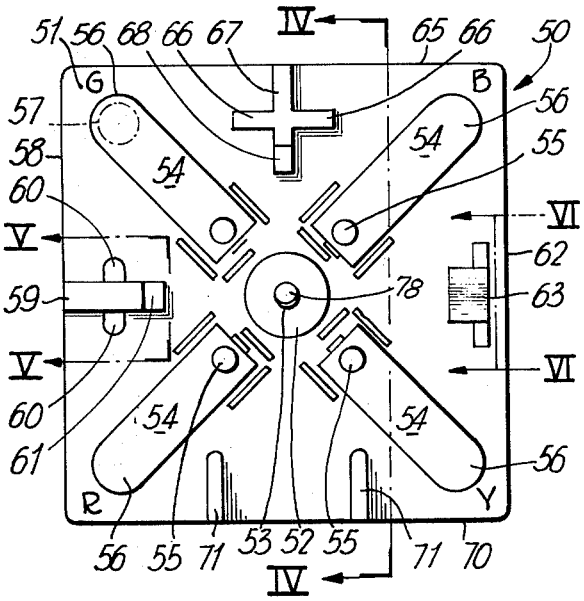
FIG. 3 is a plan view of the underside of an interconnector.
Figure 4:
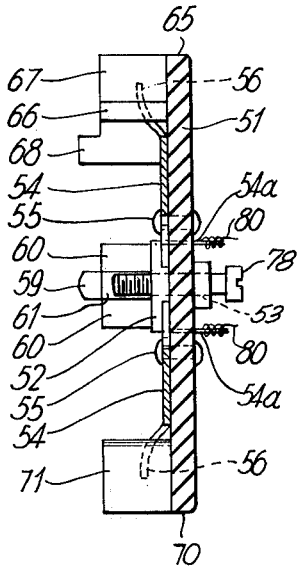
FIG. 4 is a cross-section on the line IV—IV of FIG. 3.
Figure 6:
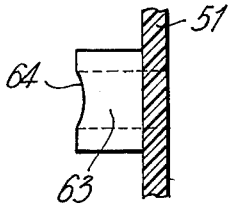
FIG. 6 is a cross-section on the line VI—VI of FIG. 3.
Figure 9:
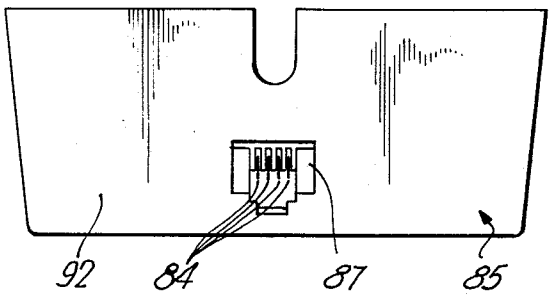
FIG. 9 is a side view of the cover of FIG. 7 in the direction of the arrow A.
Figure 8:
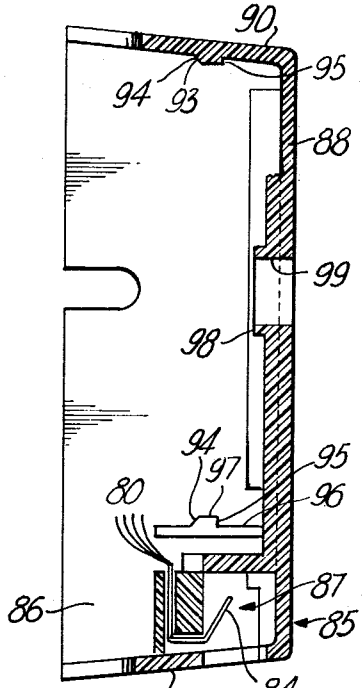
FIG. 8 is a cross-section on the line VIII—VIII of FIG. 7.
Figure 7:
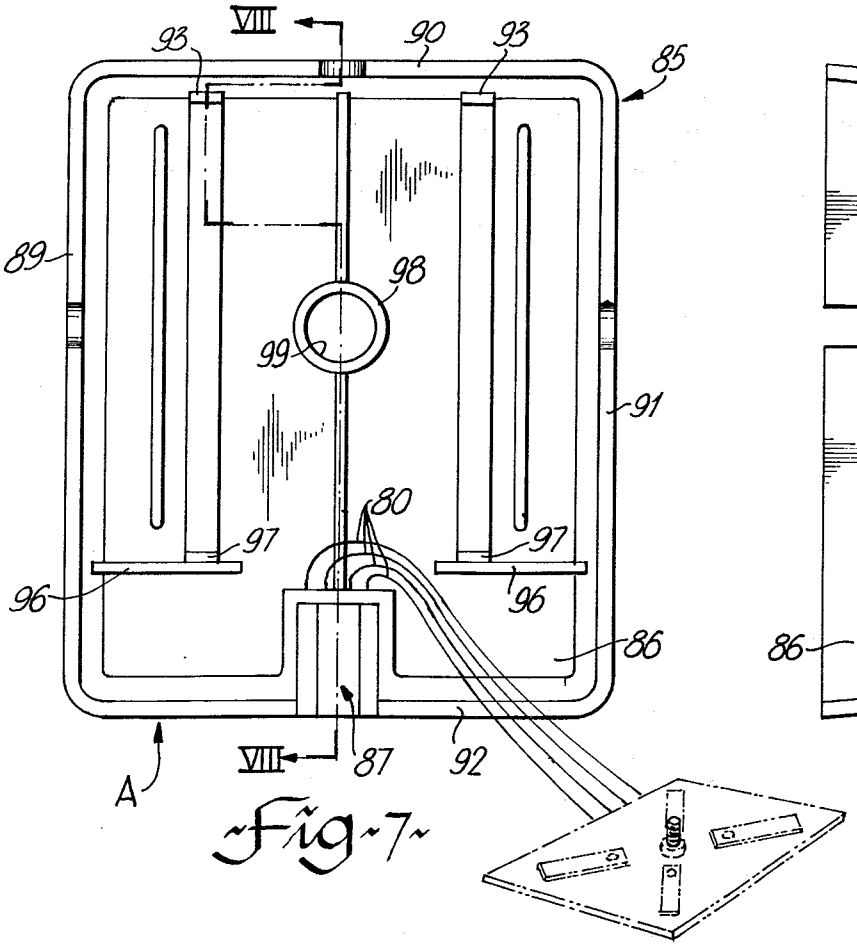
FIG. 7 is a plan view of the underside of a cover which clips on the interconnector of FIG. 3, also indicating attachment to the interconnector.

An interconnector is illustrated in FIGS. 3 to 6, particularly in FIGS. 3 and 4. The cover is illustrated in FIGS. 7, 8 and 9.

The interconnector, indicated generally at 50, has a flat square main portion 51 comparable in size to the base portions 10 and 30 of the outlets. There is a central boss 52 with a bore 53 therethrough. Extending radially from the boss 52 are four contact members 54. Each member 54 is of flat metal and is attached at one end adjacent to the boss 52, by a rivet 55 passing through the contact member and the main portion 51. The outer ends 56 of the contact members are raised away from the main portion 51, as indicated by dotted lines in FIG. 4. The contact members are resilient or "springy". The outer ends 56 are arranged to overlie the screw terminals 13 or 37 of the outlets, as indicated by dotted circle 57 in FIG. 3. The inner ends project through the main portion 51 to provide connection portions 54*a*.

Figure 5:
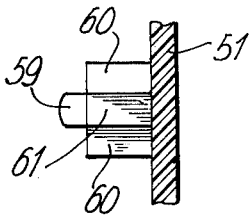
FIG. 5 is a cross-section on the line V—V of FIG. 3.

On each edge of the interconnector there are formations for engaging with certain parts of one or both outlets, for correct spacing from the surface of the outlet and to provide correct rotation orientation. Thus, as seen at the left hand edge 58 in FIG. 3, there is a rib 59 extending normal to the edge 58. Approximately midway along the rib 59 are two side extensions 60, while the inner end 61 of the rib 59 extends upward slightly less than the main part of the rib 59 as seen in FIG. 5. On the right hand edge 62 there is a Tee shaped rib 63, viewed in plan form in FIG. 3. The stem of the Tee shape extends towards the central boss 52, the top of the Tee extending parallel to the edge 62. The top surface of the stem portion is slightly concave, as seen in FIG. 6 at 64.

On the edge 65 there is a cross-shaped formation formed by two ribs 66 and 67 which intersect each other, one rib 66 being parallel to the edge 65 and the other rib 67 extending from the edge 65 and normal thereto. The inner portion of rib 67 has a raised portion 68, as seen in FIG. 4. On the edge 70 there are two parallel ribs 71 extending from and normal to the edge 70.

The main portion of rib 67, the top of the Tee shape 63, the ribs 71 and the side extensions 60 all extend from the surface of the main portion 51 the same distance and serve to space the interconnector from the outlet, different parts of these items contacting parts of one or the other of the outlets, depending upon the type.

Thus, considering the outlet of FIG. 1, and the interconnector 50, the interconnector is turned over from the position illustrated in FIG. 3. By this movement the rib 59 enters the slot 15, with the side extensions 60 resting on the rim portion 12. The ribs 66 and 67 rest on the raised rim portion 10 with the portion 68 engaging the inner surface of the rim portion, the two ribs 71 engage with the raised rim portion 12 on either side of the protrusion 22 and also are in contact with the ends of the protrusion. The stem portion of the Tee shaped formation 63 enters the recess 18, the top portion of the Tee, either side of the stem portion, engaging with the rim portion 12. The interconnector is thus positioned relative to the outlet. If the interconnector is reversed top to bottom, i.e. 180° out of correct position, then the interconnect will not seat down as the cross-shaped formation of ribs 66 and 67 will rest on the protrusion 22. Similarly, if the interconnect is 90° out of orientation the rib 59 and the stem portion of the Tee shaped formation 63 would rest on the raised rim portion 12 instead of entering the slot 15 and recess 18.

Figure 10:
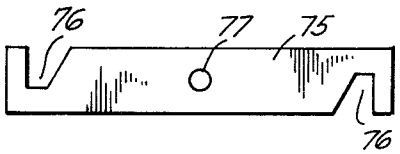
FIG. 10 is a plan view of an adaptor part for the form of outlet in FIG. 1.

To provide for attachment of the interconnect to the outlet of FIG. 1, the attachment screws in the holes 11 are loosened and an adaptor part as illustrated in FIG. 10 inserted. The adaptor part - 75, is a flat strip of metal with slots 76 formed therein, one near each end, the slots entering from opposite sides. A central threaded hole 77 is also formed in the adaptor part. After loosening the attachment screws the part 75 is placed on the surface of the recessed body portion and rotated so that the slots engage with the fastening screws, which are then tightened. After placing the interconnector on to the outlet, a screw is passed through the hole 53 in the central boss 52 of the interconnector and tightened down. Tightening of the screw forces the raised ends 58 of the contact members 54 into firm contact with the screw terminals 13.

Wires 80 are wire wrapped, or otherwise attached, to the contact portions 54*a* at the factory.

Considering now the interconnector 50 and the outlet of FIG. 2, the main portion of rib 59 and the side extension 60 are within the recess 33, with the lower inner end 61 of the rib 59 resting on the flat main body portion 30 and the main portion of the rib 59 butting against the curved periphery of the recess. The cross-shaped formation of ribs 66 and 67 are over the top re-entrant recess 34, as seen in FIG. 2, with the inner surface of the raised portion 68 of rib 67 engaging with the peripheral edge of the recess. The Tee shaped formation has its top portion resting on the flat main body portion 30 external to the ribs 40 and the ribs 71 rest on the body portion 30 at the narrow opening to the bottom re-entrant recess 34, as seen in FIG. 2. The central boss 52 rests on the boss 44 of the outlet.

If the interconnector is incorrectly orientated, for example by being 90° rotationally mispositioned, either the ribs 71 will rest on top of the ribs 40 preventing proper seating, or the rib 66 will rest on the ribs 40, again preventing proper seating. If there is 180° rotational displacement, the side extensions 60 will rest on the ribs 40 preventing proper seating.

With correct positioning of the interconnector on the outlet, a captive screw 78 passing through the hole 53 of the central boss 53 is screwed into the threaded insert 43 of the outlet. Tightening of the screw presses the raised ends 56 of the contact members 54 on to the screw terminals 37.

The interconnector 50 is provided with a snap-on cover 85 — FIGS. 7, 8 and 9. The cover is rectangular, being slightly wider than the interconnector so as to clip over but being longer so as to provide an extension or overhang — indicated generally at 86. This extension houses a jack 87 the contacts 84 of which are prewired to the contact members 54 — by the wires 80. The cover 85 can be clipped on in any rotational orientation relative to the interconnector, thereby permitting the jack 87 to face in any of four directions, at the will of the user. The cover is molded of plastic material having limited resilience, and comprises a top surface or web 88 and four walls 89, 90, 91 and 92, wall 92, in the example illustrated being that in which the jack 87 is positioned. Wall 90, being the wall opposite to wall 92, has two small ribs 93 molded thereon. The ribs have an inclined lower surface 94 and an upper surface 95 parallel to the top surface or web 88. The spacing of the ribs 93 from the inner side of the top surface or web 88 is such that the ribs pass over and engage under the main portion 51 of the interconnector.

An intermediate wall 96 extends in two portions across the cover to define the extension or overhang 86, being opposite wall 90 and parallel to wall 92. A small rib 97 is formed on each portion of the intermediate wall each rib 97 being opposite a rib 93 and having a similar form, i.e. an inclined surface 94 and an upper surface 95. Ribs 97 also pass over and engage under the main portion 51 of the interconnector.

The interconnector and cover are supplied attached together by the wires or leads 80. The interconnector is attached to the outlet, using the captive screw. The cover is then clipped on, in any rotational position as required. The head of the captive screw is accessible through the hole 99 in the cover and the complete assembly can be removed and replaced as necessary.

What is claimed is:

1. A common interconnector for adapting either of two forms of existing telephone outlets for telephone sets, the outlets each having screw terminals for attachment of conductors of the telephone system and the telephone sets connected to the outlets by plugs having a number of pins or by direct wiring to said terminals, said interconnector adapting said outlets to a form having a profiled aperture for accepting a profiled plug of a plug-in telephone unit and comprising:

a flat square main member having two opposed parallel surfaces;

a central boss extending from one of said parallel surfaces and a bore through said central boss;

four radially extending spring contact members on said one surface, said spring contact members extending from said central boss towards the corners of said main member, said contact members attached to said main member at their inner ends adjacent to said boss and including outer ends adjacent the corners of the main member and spaced from said one surface, said outer ends positioned to contact said screw terminals in said existing outlets when said main member is positioned on either of said two forms of existing outlet;

formations on said one surface, said formations comprising a formation at each edge of the main member, each formation of unique form and differing from the other of said formations, and adapted to interengage with existing formations at the periphery of the existing outlets, to provide a predetermined rotational relationship between the main member and the existing outlets independent of the particular one of said two existing outlets;

means for attaching said main member to an outlet;

a hollow snap-on cover fitting over said main member, said cover of rectangular form having four sides, three sides form a close fit over three sides of said main member, a transverse wall extending laterally across the interior of the cover, said transverse wall forms a close fit over the fourth side of said main member, said cover extending beyond said main member to form an extension bounded by a fourth side of said cover;

a jack positioned in said extension, said jack including contacts connected to said spring contacts on said main member; and an aperture in said fourth side of said cover, said aperture having a predetermined profile for acceptance of a profiled plug therein, said aperture aligned with said jack to permit the spring contacts on said plug to engage said contacts in said jack.

2. An interconnector as claimed in claim 1, said means for attaching said main member to an outlet comprising an adaptor for attachment to one of the said two forms of outlet, said adaptor comprising an elongated strip of material having a laterally extending slot at each end, said slots entering said strip from opposite sides and positioned to slide under two of said screw terminals, and a central threaded hole in said strip, a screw passing through said bore in said central boss of said main member into said threaded hole for attachment of said main member, and including a bore in said cover permitting access to said screw.

3. An interconnector as claimed in claim 1, said main member attached to said outlets by a screw passing through said bore in said central boss into a threaded member in one of said forms of outlet, and a bore in said cover, said bore in said cover permitting access to said screw.

* * * * *